US005190186A

United States Patent [19]

Yablans et al.

[11] Patent Number: 5,190,186

[45] Date of Patent: Mar. 2, 1993

[54] MULTI-PACKAGE ADJUSTABLE SHELF DISPLAY DISPENSER

[75] Inventors: Gerald Yablans, Port Washington, N.Y.; David C. Miller, New Canaan, Conn.

[73] Assignee: P.O.P. Displays, Inc., Long Island City, N.Y.

[21] Appl. No.: 682,856

[22] Filed: Apr. 5, 1991

Related U.S. Application Data

[63] Continuation-in-part of Ser. No. 571,566, Apr. 6, 1990, abandoned.

[51] Int. Cl.[5] ..... G07F 11/02

[52] U.S. Cl. ..... 221/124; 221/279

[58] Field of Search ..... 221/12, 124, 125, 131, 221/227, 255, 279; 211/43, 51, 59.3, 94.5; 312/61, 71

[56] References Cited

U.S. PATENT DOCUMENTS

| | | | |
|---|---|---|---|
| 2,738,881 | 3/1956 | Michel | 211/59.3 |
| 3,308,961 | 3/1967 | Chesley | 211/59.3 |
| 3,357,597 | 12/1967 | Groff | 211/59.3 X |
| 3,848,745 | 11/1974 | Smith | 211/59.3 |
| 4,724,968 | 2/1988 | Wombacher | 211/59.3 |
| 4,729,481 | 3/1988 | Hawkinson et al. | 221/279 X |
| 4,730,741 | 3/1988 | Jackle et al. | 211/59.3 |
| 4,762,236 | 8/1988 | Jackle et al. | 211/59.3 |
| 4,836,390 | 6/1989 | Polvere | 211/59.3 |
| 4,907,707 | 3/1990 | Crum | 221/279 X |

*Primary Examiner*—Joseph E. Valenza
*Assistant Examiner*—Dean A. Reichard
*Attorney, Agent, or Firm*—Nolte, Nolte and Hunter

[57] ABSTRACT

A display comprising a package pusher operated by coiled springs and slidable along guides to push packages forward on a shelf. The guides are adjustably laterally movable in a feed structure to accommodate packages of varied size. The feed structure includes front and rear brackets connected to each other and/or securable to a display shelf. In one embodiment, the structure connecting the brackets is provided with breakaway portions to customize its length.

36 Claims, 12 Drawing Sheets

FIG. 3
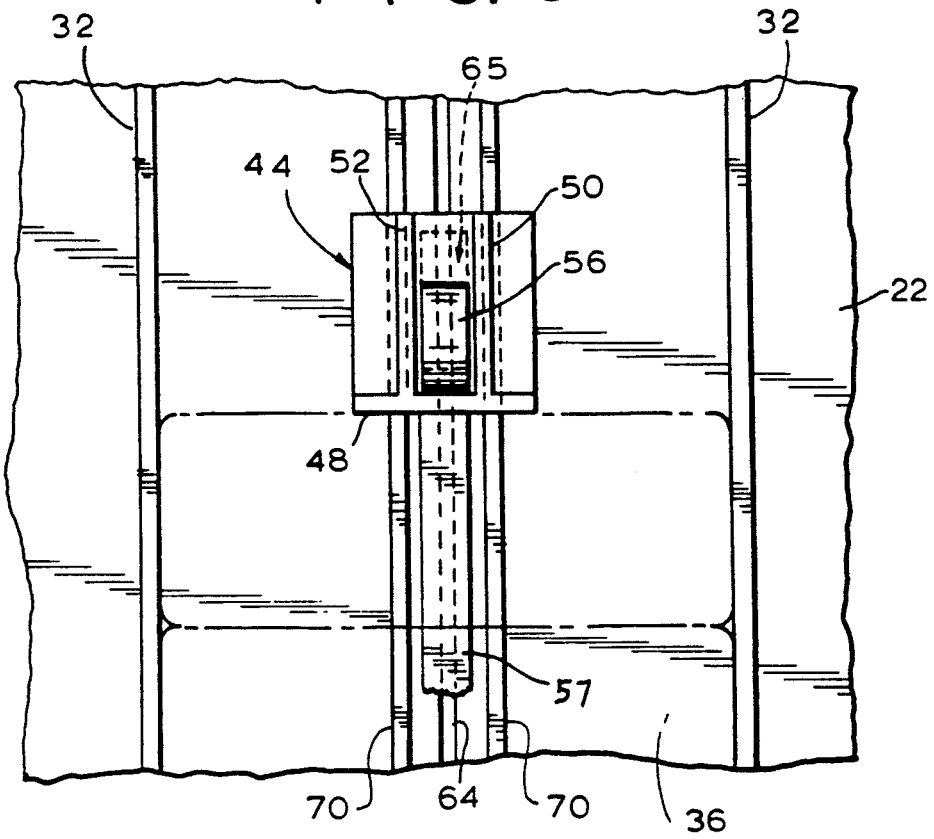
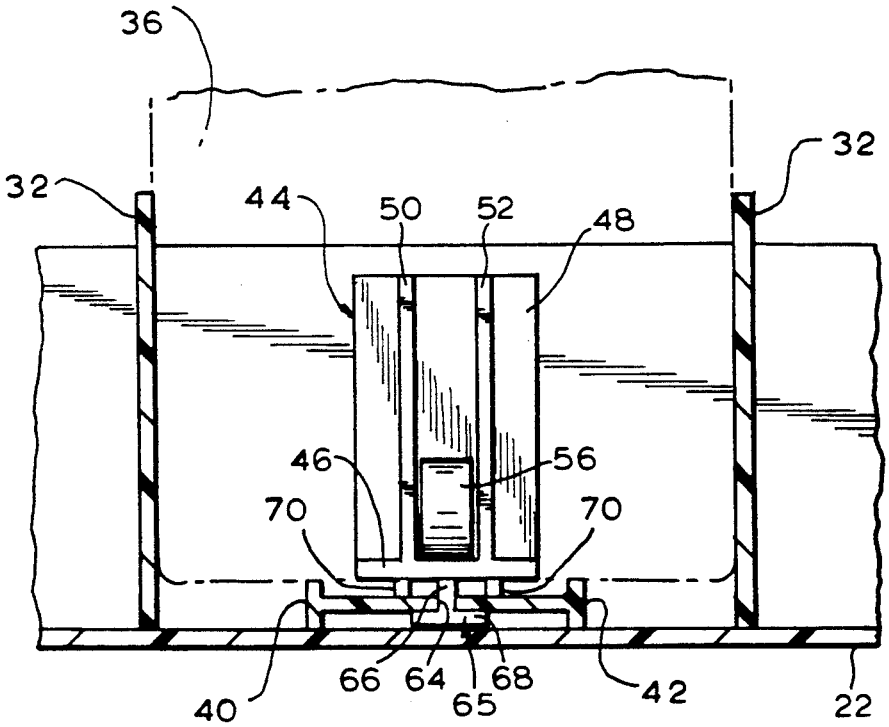
FIG. 5

FIG. 6
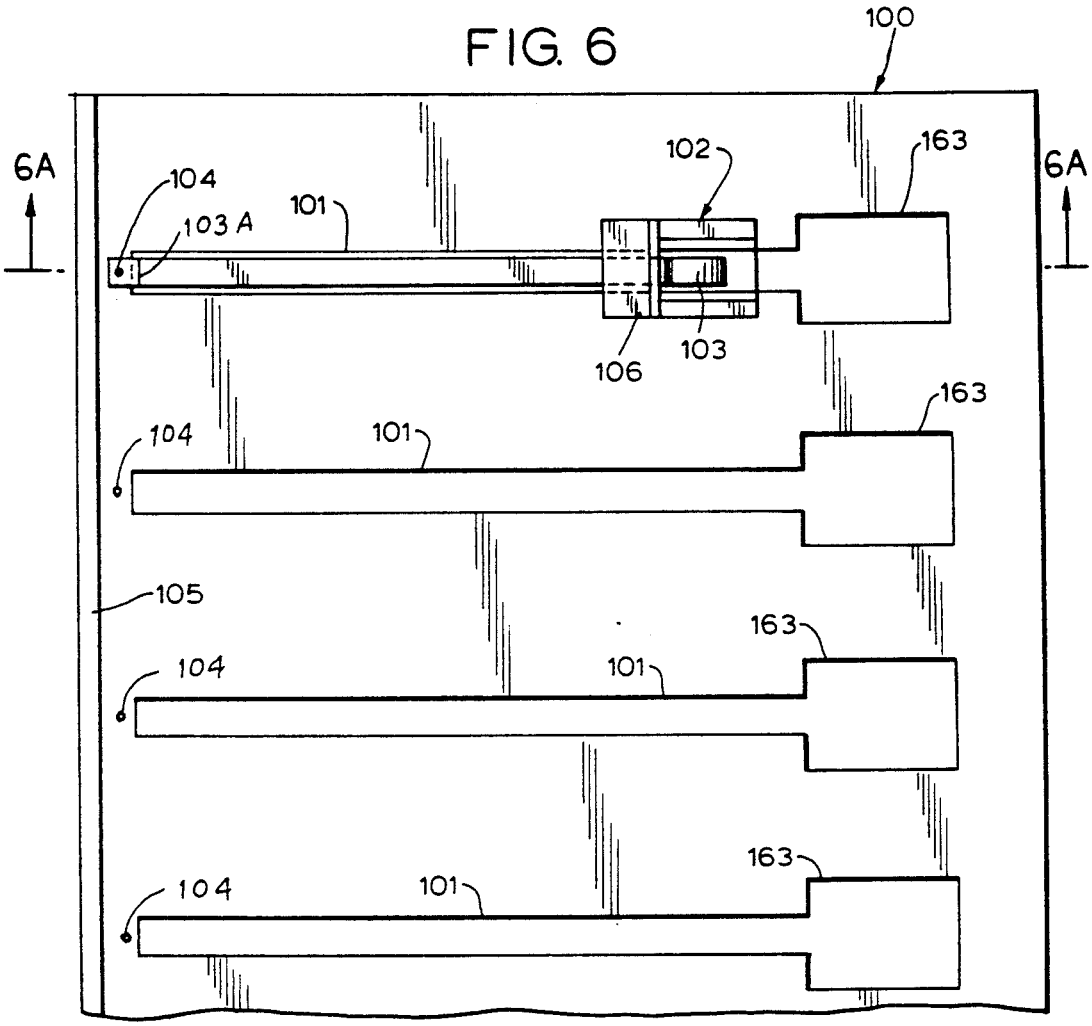
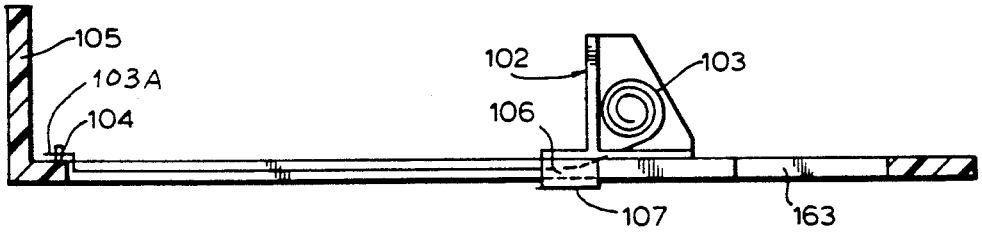
FIG. 6A

MULTI-PACKAGE ADJUSTABLE SHELF DISPLAY DISPENSER

This is a continuation-in-part of my co-pending application Ser. No. 07/571,566, filed Apr. 6, 1990 and now abandoned.

FIELD OF THE INVENTION

The present invention relates to shelf display and placement of packages.

BACKGROUND OF THE INVENTION

Prior art displays such as disclosed in Jackle III et al., U.S. Pat. No. 4,762,236, provide coil springs moving a trolley or pusher so as to advance packages forwardly of a display shelf. Stevens U.S. Pat. No. 2,652,154 also discloses a similar trolley biased by a rubber strand requiring a roller and anchoring pin. Ord, U.S. Pat. No. 3,291,544, discloses an article dispensing system with a spring biased pusher. Hawkinson, U.S. Pat. No. 4,729,481, discloses a packaged goods advancing system in which a tensioned sheet or belt is provided for advancing the goods. Dechirot, U.S. Pat. No. 4,821,894 and Roberts, U.S Pat. No. 4,475,658, disclose mounting packages with a coil spring coupled for urging a thrust plate and inventory control cards for advancing the packages, respectively. These prior art structures are very elaborate and complicated.

THE INVENTION

By the present invention, the packages which are moved forward in parallel columns as each forwardmost package is removed, are pushed by pusher elements which are laterally displaceable to accommodate and position different sized packages. Tray elements incorporating the laterally displaceable pusher elements provide stable placement of the pushers and are provided in modular sections providing customized package display and placement apparatus for different shelf sizes.

This invention relates to shelf displays for packages of the type in which packages are moved forward in parallel columns for display and dispensing one by one from each column. In any given column the packages are preferably of uniform size, but adjacent columns may feed different sized packages. It is an object of the invention to provide an assembly for feeding variant and variable sized processions in parallel formation. It is a further object to provide for ready adjustment of the dispenser to accommodate various package dimensions. It is an object to provide a relatively low-cost (non-labor intensive) structure, that is readily and conveniently adjustable to arrange for displaying packages and for presenting such packages one by one for removal from a display shelf.

It is a further object of the invention to provide in such a structure the capability of last in, last out feed to maintain stock freshness and visual display of on shelf inventory.

In the first instance, the objects of the invention are carried out by the provision of a coil spring riding on a trolley with the end of the coil spring secured adjacent a forward wall on a shelf with the trolley sliding on rails and guided by a slot from a rearmost position where several packages have been disposed in front of it to a forwardmost position as each package in the procession of packages is removed from the front of the shelf. The trolley is movable laterally either by disposing it on a slide which slide is retained at its forward and rearward ends by the rearward and forward walls of a display tray disposed on a shelf; or by positioning the trolley within one of several parallel laterally spaced slots formed in a shelf having a forward wall.

Another object of the invention is to provide a modified forward wall (or forward and rearward walls) that may be secured to an existing shelf to accommodate a trolley and slide thereon.

A further object of the invention is to provide a modified form that incorporates the above advantages and additionally will accommodate itself to a plurality of standard shelf widths or depths (the distance from the rearward aspect of the shelf to the forward aspect). Thus, uniform casting of the parts may be made and customized at the point of installation to accommodate to the width or depth of the shelf.

BRIEF DESCRIPTION OF THE DRAWINGS

FIG. 3 is an enlarged plan view of a segment of FIG. 1.

FIG. 5 is taken on line 5—5 of FIG. 4.

FIG. 6 is a schematic top plan view of a shelf providing laterally spaced slots for receiving a coil spring trolley;

FIG. 6A is a sectional view of the shelf of FIG. 6 taken along lines 6A—6A of FIG. 6;

DETAILED DESCRIPTION OF THE DRAWINGS

Figure 1:
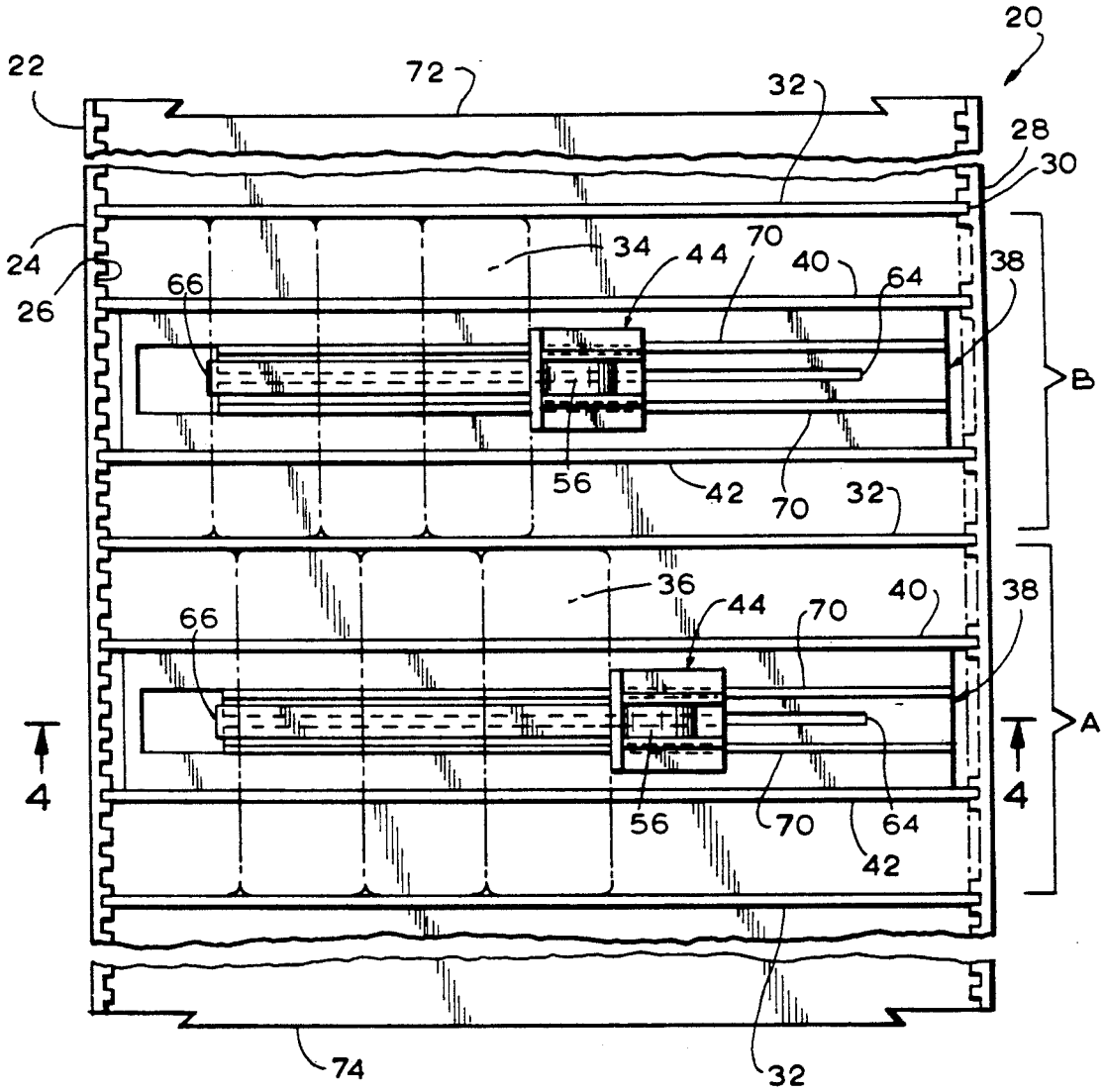
FIG. 1 is a plan view of a preferred embodiment of the invention.

Referring more specifically to the drawings, the display mechanism 20 comprises a tray 22 having an upstanding wall 24 with a dentate vertical groove structure 26 formed on the inward facing side of wall 24. A similar upstanding rearward wall 28 faces the wall 24 and has its dentate structure 30 facing toward the wall 24 and in register therewith. The dentate structures 26 and 30 preferably but not necessarily extend vertically the whole height of the walls 24, 28.

The sides of the tray 22 provide female and male dove-tails 72, 74 respectively for stable connection of adjacent trays 22 upon an existing display shelf.

Vertical structures or guides 26, 30 in corresponding register one to the other receive the spacers or walls 32 to define a channel for guidance of a procession or column of packages 34 and 36. As shown in FIG. 1, packages 36 have a larger dimension than the packages 34. Therefore, the channel formed by the spacers 32 is wider for packages 36 as indicated by the dimension A than the width for packages 34 indicated by the dimension B. These distances, A and B, can be varied by selection of registering guides 26, 30 in which the spacers 32 are supported.

The spacers 32 may be eliminated when packages are shaped as to minimize lateral displacement when pushed forward in a procession.

Figure 2:
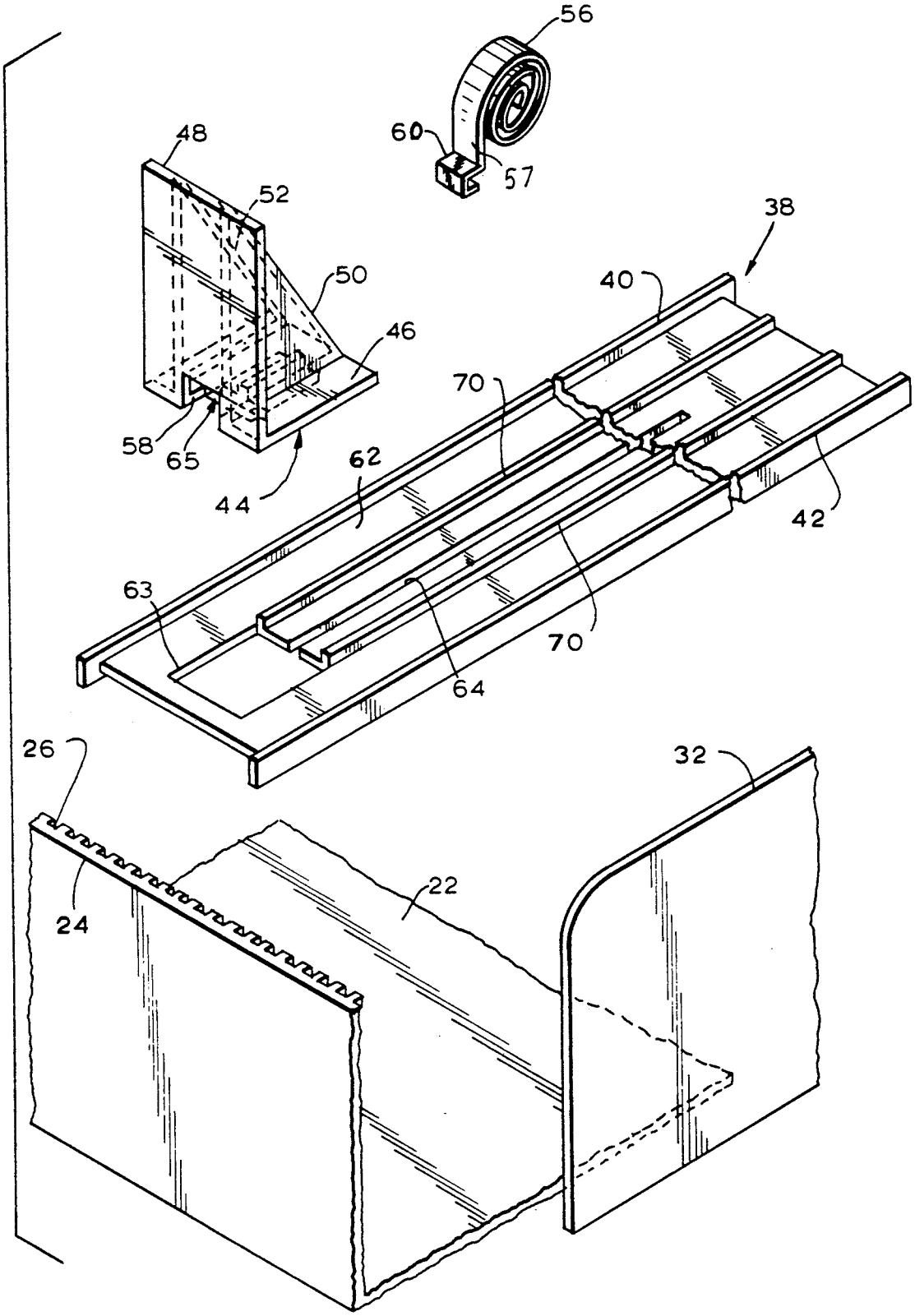
FIG. 2 is a fragmentary isometric exploded view of the same.
Figure 4:
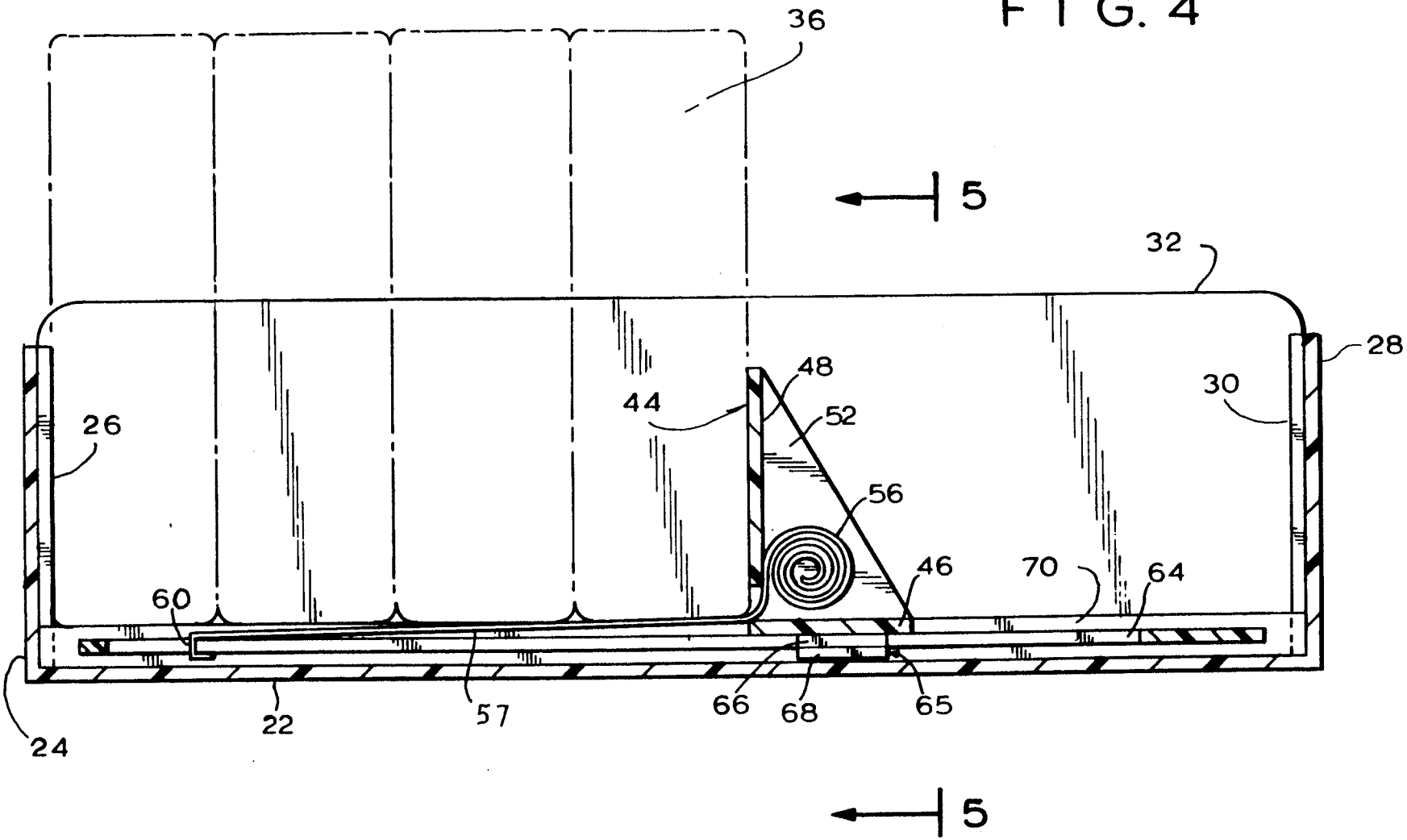
FIG. 4 is a sectional elevation taken on the line 4—4 of FIG. 1.

Mounted between a pair of walls or spacers 32 is a feed structure or slide 38 having side rails 40 and 42 (FIG. 2) which engage vertical grooves of the dentate structures 26 and 30. Rails 40, 42 are joined and spaced by plate 62. A pusher foot 44 has a horizontal plate 46, a vertical pusher plate 48 and supporting triangular spaced braces 50, 52. Braces 50 and 52 form with pusher plate 48 a chamber to contain the coil spring 56. The plate 48 has formed in it an opening 58 communicating with the chamber through which the terminal catch 60 and body portion 57 of spring 56 may extend and be drawn out as shown in FIG. 4. Tension of coil spring 56 urges the coil against plate 48 while braces 52, 50 prevent twisting of coil and body portion 57. The plate 62 supports parallel tracks 70 and has formed in it a slot 64 communicating with an enlarged aperture 63 formed in plate 62. A plow 65 is secured to the bottom of plate 46. Plow 65 has a vertical member 66 carrying a horizontal flange 68. The plow 65 engages slot 64 while its plate 46 rides on tracks 70. The flange 68 holds down plow 60 while spring 56, with its catch 60 secured in aperture 63 (see FIG. 4) urges the pusher 44 forward (to the left in FIG. 1).

In operation, the mechanism 20 may be extended as a retail shelf construction or the mechanism 20 or several of them in side by side relation may be placed on an existing retail shelf or in any desirable cabinet or supplied with a cover (not shown) covering all but the front end, shown at the left in FIG. 1. Packages 34, 36 ride on rails 40, 42. To load packages, the pusher foot 44 is moved to the right and new packages added preferably to the rear (right FIG. 1). The packages are fed, one at a time, to the front of the machine at the left. The pusher foot 44 under the urging of the spring 56 slides the packages forward on rails 40, 42 between the adjustable walls 32 to the front end of the machine (left as shown in FIG. 1).

Dimensions of the tray 22 are a matter of discretion as to width and depth. Regardless of its dimensions and regardless of the number of slides 38 employed, spacing between the walls 32 is adjustable and the centering of the slides 38 in the channel formed between the walls 32 in all adjusted positions is made possible.

The spacers 32 may be eliminated when packages are shaped to provide flat adjacent surfaces fore and aft and lateral displacement is minimized. In such instances, the rails 40, 42 of the feed structure 38 are positioned in selected vertical grooves of walls 26, 30 to center the forward force against the center of the rearmost package.

The invention conceptually contemplates the provision of a shelf 100 as depicted in FIGS. 6 and 6*a*, provided with laterally-spaced slots 101 for receiving and guiding a trolley comprising pusher foot 102 mounting a coil spring 103. The distal end 103A of the coil spring is secured to a pin 104 at the forward portion of the shelf which also provides an upstanding wall 105 against which the front package of the procession of packages is forced and which serves as a stop. The base of the pusher foot has an integral plow 106 and a hold-down plate 107 to slide along slot 101. An enlarged aperture 163 communicates with the slot 101 and is of sufficient size to permit transfer of the plate 107, plow 106 and pusher foot 102 to any selected slot 101. Free end 103A of spring 103 is secured to a pin 104 at the end of the corresponding selected slot 101.

Springs 56 and 103 are shown mounted so the free end leads from the top of the coil (spring 56) or from the bottom of the coil (spring 103). I have found both these arrangements useful. Spring 56 as shown presses downwardly as well as forwardly, while spring 103 as shown tends to lift the pusher upwardly.

A plurality of pushers 102 may be employed in adjacent, alternate or otherwise spaced slots 101 depending upon the size of the article fed.

Figure 7:
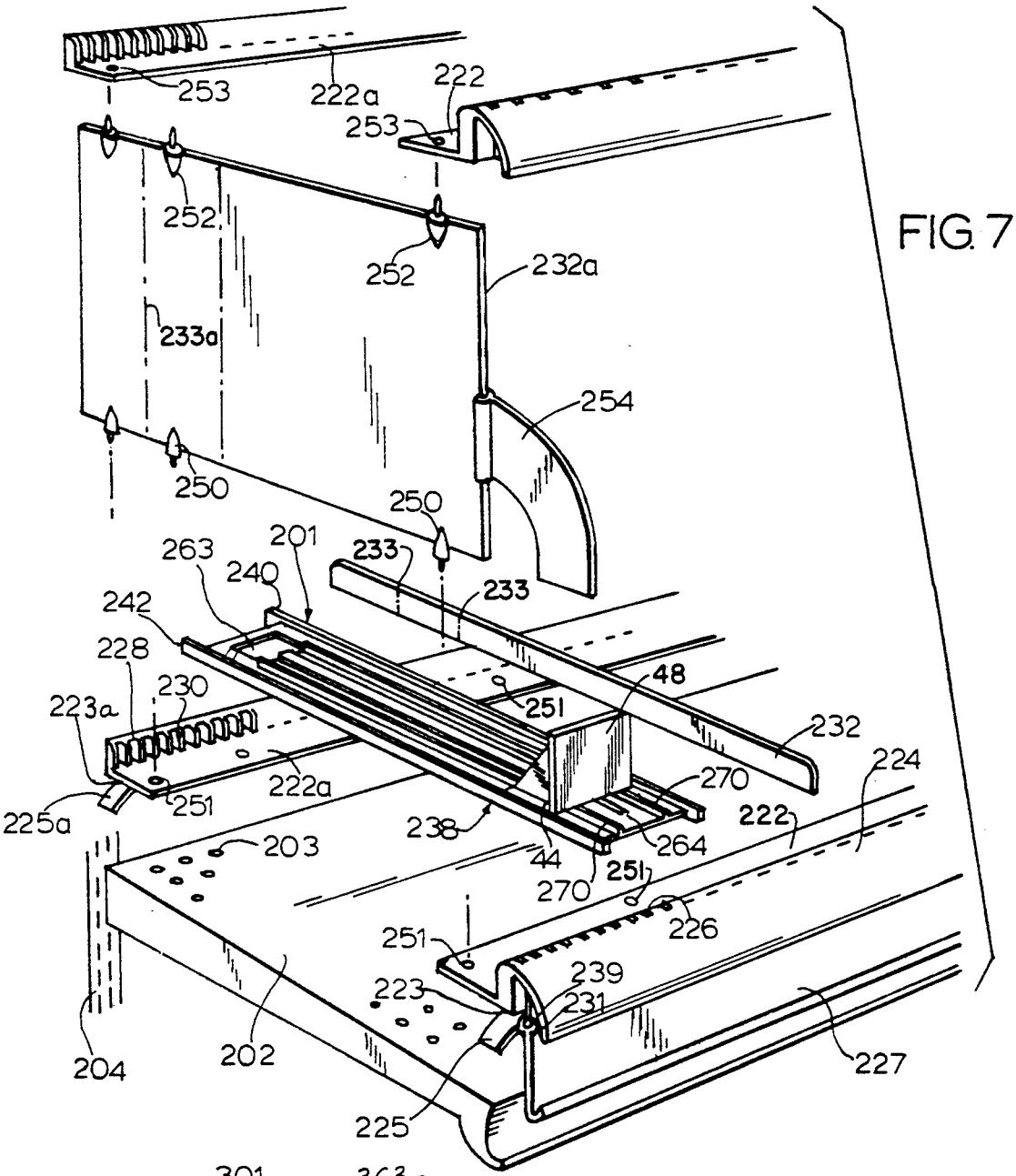
FIG. 7 is an exploded view showing another embodiment of the invention.

Referring now to the embodiment shown in FIG. 7, there is shown a shelf or display counter 202 supported on the mounting strips 204 secured to means not shown, but which may be a wall or a supporting frame. Shelves 202 and their supporting means 204, per se, do not form a part of the invention, but are any conventional shelving or counter for displaying merchandise. The front wall 224 has the dentate vertical groove structure 226 on its inward or rearwardly facing side. An integral tray portion 222 extends rearwardly for a short distance from beneath the wall 224. Securing means, such as the foamed pressure sensitive tape 223 secured to the bottom of tray 222, is exposed by peeling protective strip 225 so tray 222 is secured to shelf 202. Other securing means may be employed, for example, screws, clips or nuts and bolts in holes 203. Many commercial shelves 202 already have a plurality of pre-bored openings 203 in them for securing structures to them. Optional price channel 227 may be supplied beneath the overhang of front wall 224 by interfitting the rod 239 depending from the overhang and the channel 231 forming the top of price channel 227, either by sliding the channel over the rod or by springing the mouth of the channel open against the rod.

The rearward wall 228 has an integral tray portion 222*a* secureable at the rear of shelf 202 in the fashion described above for portion 222 via foamed pressure-sensitive tape 223*a* after pulling off protective strip 225*a*. Rearward upstanding wall 228 has on its forwardly facing side the dentate vertical structure 230.

The spacers or dividers may be low, as shown at 232, or they may be high as indicated at 232*a* for purposes to be explained. The spacers or dividers 232, 232*a* (only one of each being shown) form side-by-side channels for supporting and guiding goods and are supported in the registering dentate structures 226 and 230. In this embodiment of the invention, the slider or conveyor mechanisms 238 (only one of which is shown) are normally centered between adjacent dividers 232 (232*a*). The front and back ends of side supports or rails 240, 242 interengage selected dentate structures 226, 230. The rails 270 and/or side supports 240, 242 support products for low friction sliding and for spacing the products above the bottom or floor of the slide mechanism 201. Slide 238 has a formed slot 264 to receive vertical member 66 of plow 65 of pusher 44 held down by flange 68 illustrated in FIGS. 4 and 5. The channel formed between the rails 270 provides space beneath the goods for the spring 56 of pusher 44. The enlarged aperture 263 is positioned at the rearward end of the slider 238 to provide a means of engaging plow 65 in slot 264.

Still referring to FIG. 7, reference is made to the high divider or separator 232*a*. The high divider 232*a* shown is supported on the tray portion 222, 222*a* by interengaging pins 250 and socket 251. Pins 252 at the top of divider 232*a* engage the holes or sockets 253 of a second elevated pair of tray sections 222 and 222*a*. Thus, the high dividers 232*a* structurally support and vertically space trays 222, 222*a*. The high dividers 232*a* further provide a means for applying a clip-on flag 254 for identifying, for example, sale specials.

The low dividers 232 may be used alone or in combination with the high dividers 232*a*. That is, the high dividers may be placed starting from the leftward side as illustrated in FIG. 7 and at pre-selected positions along the dentate structures. Low dividers 232 may be selectively spaced intermediate the high dividers. It is also contemplated in some adaptations to use only the high dividers 232*a*, particularly where the goods have a greater height dimension as, for example, dry cereal boxes. Thus, it is within the contemplation of the invention to selectively use the dividers 232 or 232*a* each alone or each in combination with the other.

Both high divider 232*a* and low divider 232 are provided with a number of break-off lines 233*a* and 233, respectively. Dividers 232*a* have a suitable number of pins 250 to engage the sockets 251 at the elected spacing.

Figure 9:
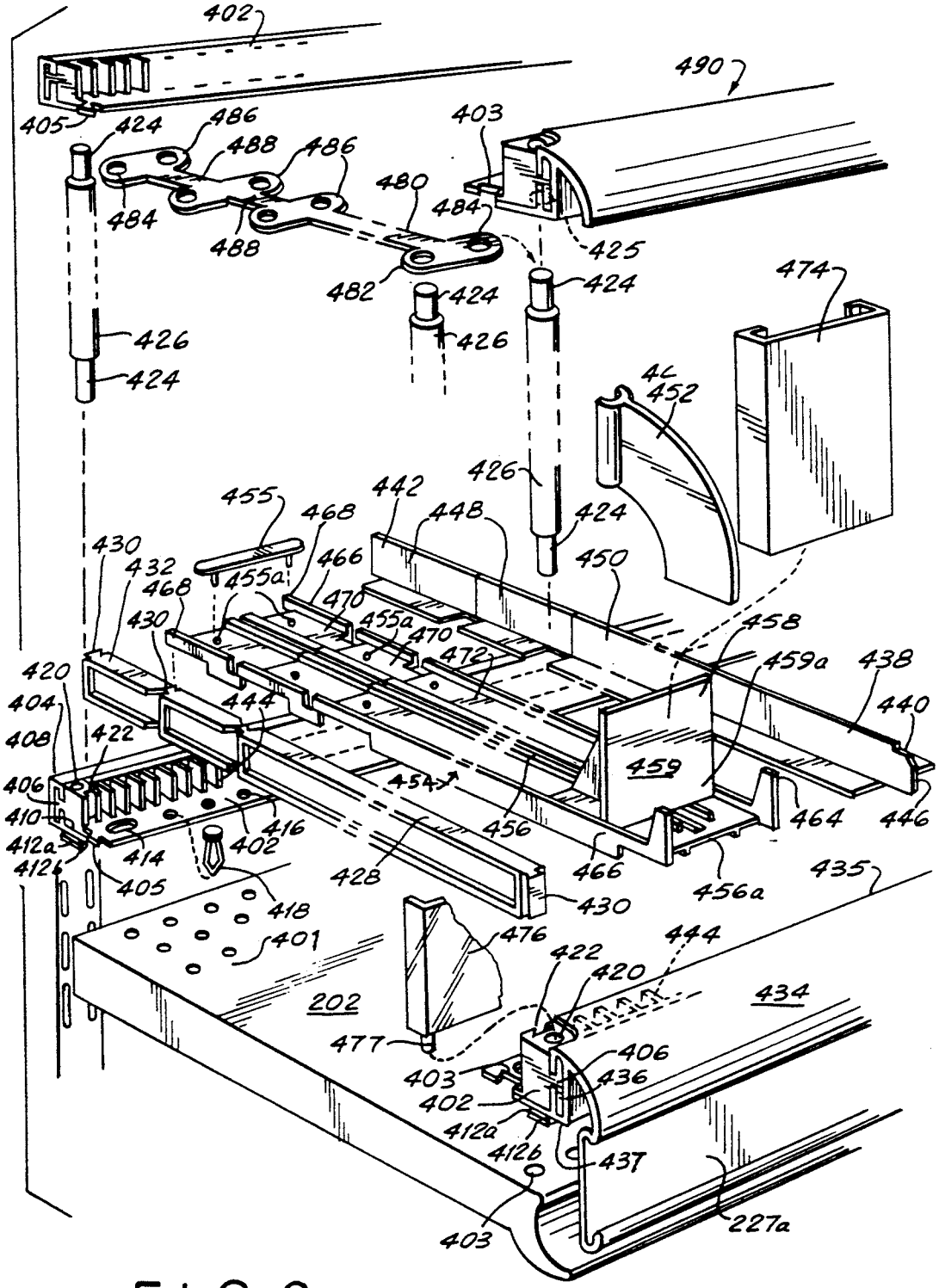
FIG. 9 is an exploded view showing another embodiment of the invention.
Figure 12:
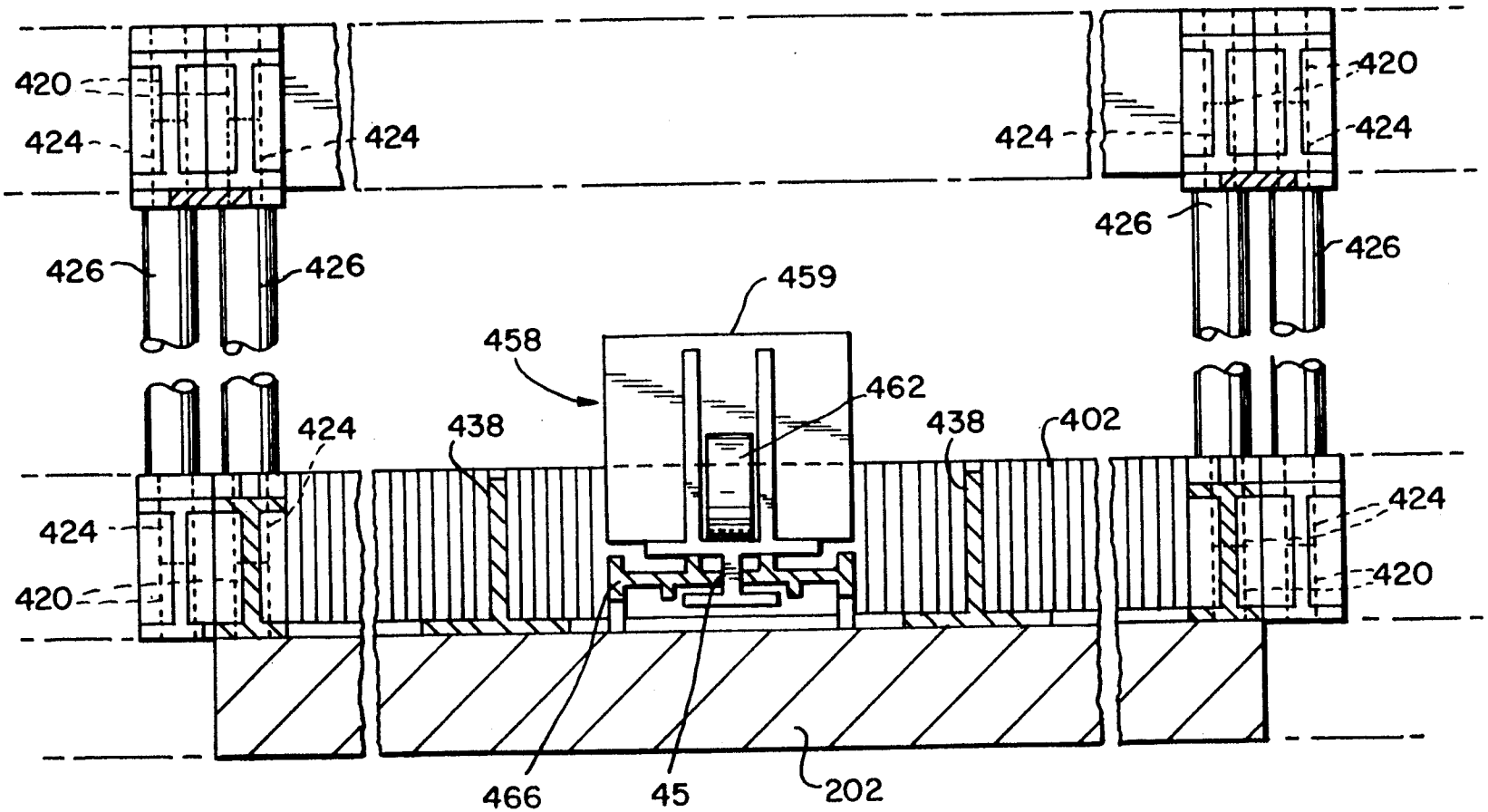
FIG. 12 is a sectional elevation taken on the line 12—12 of FIG. 11.
Figure 14:
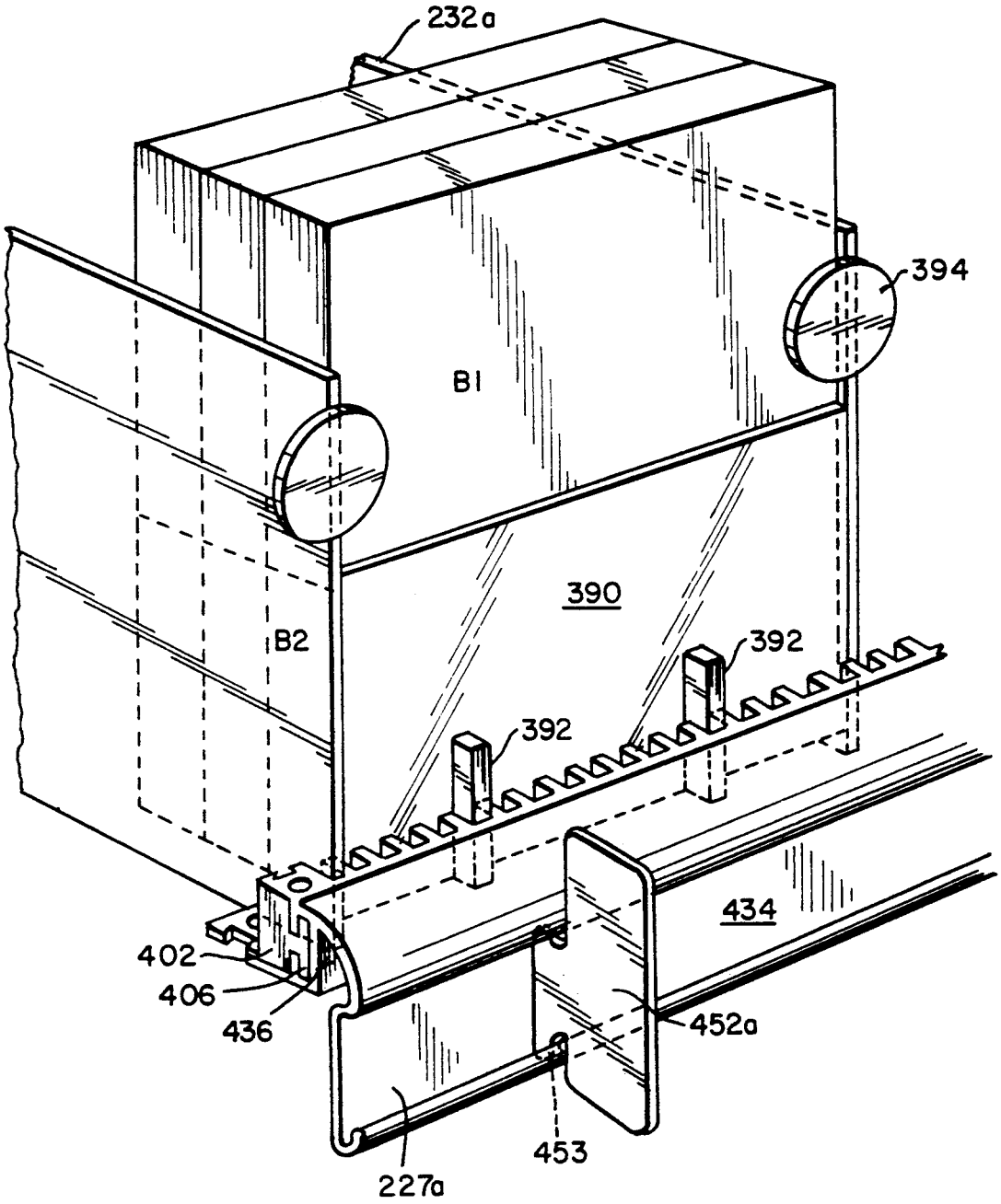
FIG. 14 is a detailed partial exploded view of a portion of FIG. 9.

Specially adapted high dividers may be provided as alternatively shown in FIG. 12, incorporating the details of the modification of the shelf dispensers shown in FIG. 9. In FIG. 14, divider 232*b* may be utilized to guide vertical columns (two or more boxes high) forward to a transparent stop 390 supported by integral clips 392 engaging the forward dentate structure 444 between or outside rails 466 of the feed structure of FIG. 9. Removal of a higher box B1 provides access to a lower box B2. Removal of B2 permits a pusher 459 (formed higher or employing an extension such as adaptor 474 shown in FIG. 9) to move the next following vertical column forward. Stop 390 arrests only the lowermost box B2. Buttons 394 formed on the forward edge of high dividers 232*b* arrest the higher boxes. Shelf-talker 452*a* has the T-shaped lug 453 which engages the C-shaped price channel 227*a*.

Figure 8:
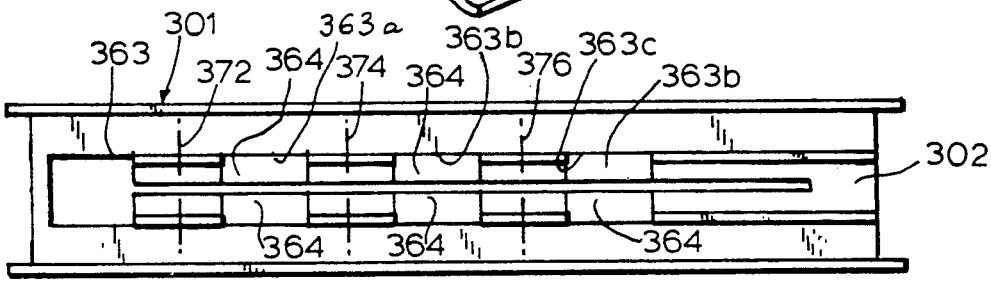
FIG. 8 is a plan view of an alternate embodiment of the slide mechanism shown in FIG. 7.

Referring now to FIG. 8, there is shown a further embodiment in the slider 301. In this embodiment, slider 301 is formed with a plurality of distal openings or possible distal openings 363, 363*a*, 363*b* and 363*c*, respectively. These apertures are formed for the same purpose as the aperture 63 shown in FIG. 2. Apertures 363*a*, 363*b*, 363*c* are formed with breakaway plugs 364, slider 301 has breakaway striations 372, 374 and 376. In order to accommodate the usual variations of the depths of shelves, these striations are two inches apart and may be broken off at 372, 374 or 376. The plug 364 within the remaining most distal opening is removed to create a new "363" distal opening.

It should be noted that reference numerals such as 163, 263 and 363 are to similar structures and this has been done with a number of reference numerals on the several sliders shown. It should also be understood that variations in securing the spring 103 (FIG. 6A) or spring 56 (FIG. 4) may be interchangeably employed in the several embodiments. The pushers 44, 102 and 458 are likewise interchangeable as will be apparent to one skilled in the art.

Figure 10:
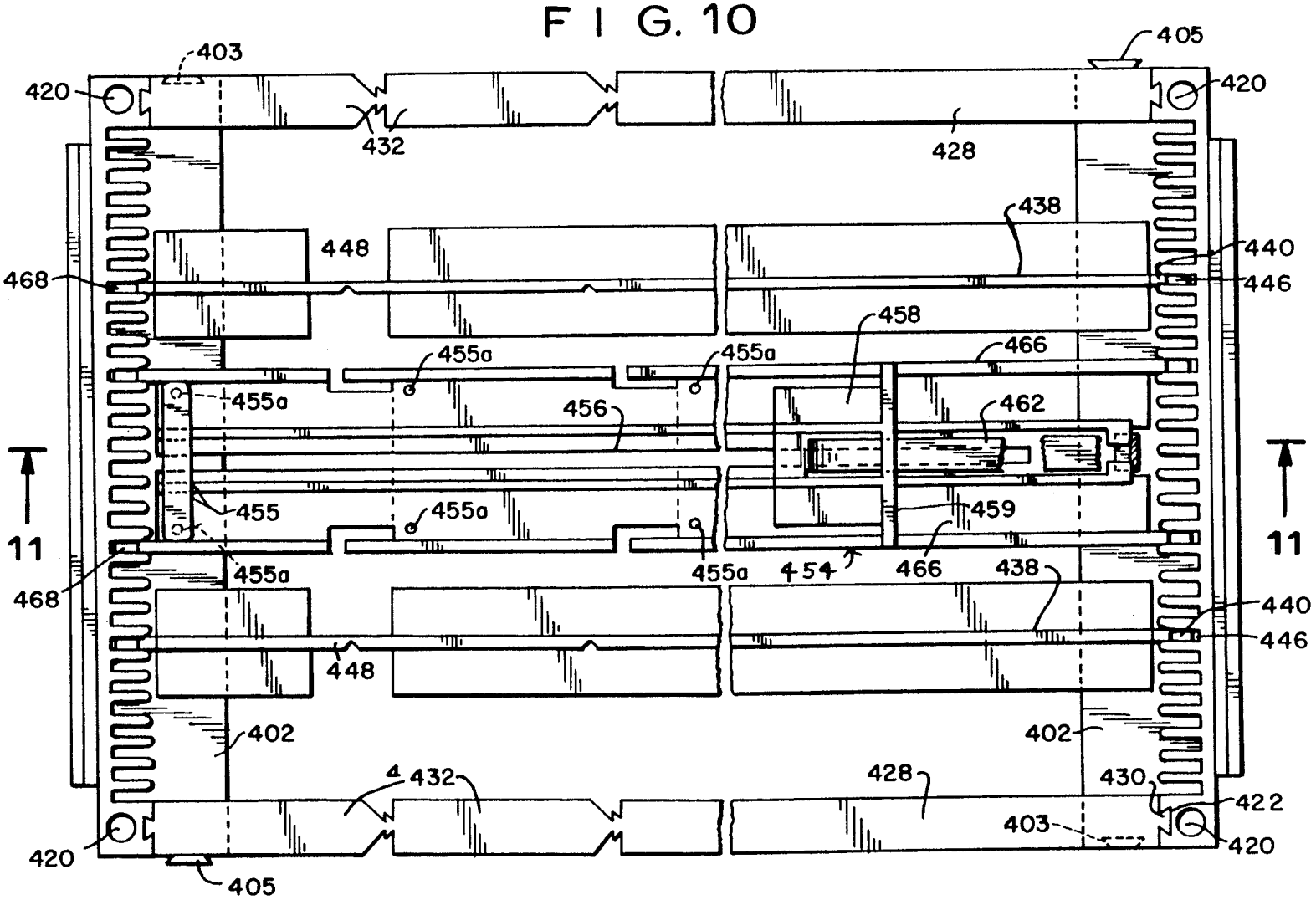
FIG. 10 is a plan view of the lower portion of the same, omitting the extrusions 435 and 404 for clarity.
Figure 11:
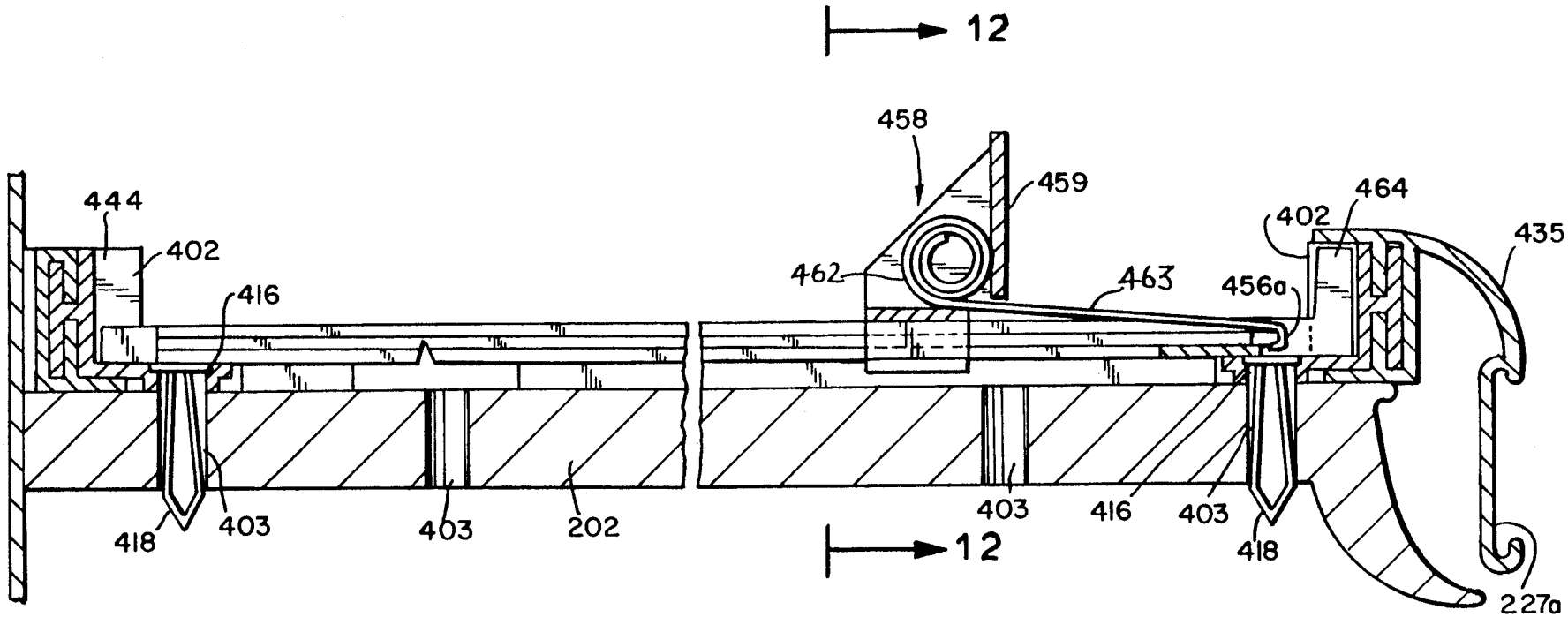
FIG. 11 is a sectional elevation taken on the line 11—11 of FIG. 10.

Referring to FIGS. 9, 10 and 11, there is shown still another embodiment of the invention. This embodiment, as the embodiment shown in FIG. 7, is designed for placement on conventional store or product display shelving 202. Here again, the shelving cooperates in providing structural support to the adjustable shelf display dispenser. Molded brackets 402 are identical and serve both as rearward brackets and forward brackets when oriented to face each other. When bracket 402 is placed in the rearward position (left in FIG. 9), it mates with the extrusion 404 by means of an integral elongated T-shaped structure 406 which is received in the elongated C-like channel structure 408 of extrusion 404. In practice, extrusion 404 may extend laterally to mate also with the T-structure 406 of an adjacent bracket 402. This ensures alignment and parallel correspondence with the front bracket 404, where the extrusion 434 may likewise extend to mate with the T-shaped structures 406 of adjacent brackets 402.

Extrusion 404 additionally has a forwardly extending shelf 410 extending beneath bracket 402. Pressure sensitive tape 412*a* is secured to the bottom of the shelf 410 and covered by the pull-off protective strip 412*b*. Tape 412*a* will adhesively secure extrusion 404 with bracket 402 to shelf 202. Bracket 402 has slots and holes 414 and 416, respectively, for further securing the brackets 402 to the shelves 202. In practice, this is generally done at the ends only of the brackets since we have found it unnecessary to have further securing means intermediate the ends of the brackets. However, numerous fastening clips 418 engaging holes 401 in shelf 202 may be employed as desired. In many cases tapes 412*a* alone are sufficient.

Each end of a bracket 402 has formed therein a receptacle or hole 420 and a dovetail slot 422. The opening 420 is designed to receive a reduced portion 424 of a post 426. Upper portion 424 of post 426 engages through a slot (not shown) in shelf 410 the orifice 420 of a bracket 402 of an identical dispensing device supported on the upper end of posts 426 as indicated in FIG. 9. Rigidity is provided to the brackets 402 by breakaway spacer bars 428 whose male dovetails 430 engage the female dovetails 422. The bars 428 establish the distance between front and rear brackets 402.

Bar 428 can have one or more breakoff portions 432 defining a further male dovetail 430 remaining after separation of the rearward portions(s) of bar 428. The breakaway sections are generally 2" in length and will accommodate common variant standard shelf depths of 10" to 22", or so.

The forward extrusion 434 is attached to a bracket 402 by engaging the integral molded portion 406 in the C-shaped portion 436 of extrusion 434. Extrusion 434 also has an underlying rearwardly extending shelf 437 to which is secured pressure sensitive tape 412*a* covered by pull-off protective strip 412*b*. The pressure sensitive tapes 412*a* are generally sufficient to hold the display unit to the shelving 202, but, if desired, securing means may engage the holes 403 at the forward edge of the shelf and the openings 414, 416 of brackets 402 in the same fashion shown for the rearward bracket 402. Either or both types of securing means may be employed. It may be here noted that when the bracket 402 is oriented for the forward position, a female dovetail 403 is to the left as shown in FIG. 9 and when the bracket 402 is oriented for the rearward position, a male dovetail 405 is to the left. This permits these dovetails to be cooperatively engaged by adjacent brackets 402 to insure that adjacent brackets are touching and held in alignment. The extrusion 434 has a price channel structure 227a which may be integrally molded as shown or clamped on in the manner of channel 227 in the FIG. 7 embodiment.

A plurality of dividers 438 are generally of an inverted T-shape in cross section. Dividers 438 have a notch 440 which allows them to be slipped beneath upper edge 435 of extrusion 434 by raising the rear end 442 of divider 438 and then dropping end 442 down to engage between spaced guides 444 of rear bracket 402. The forward terminal end 446, of course, engages guides 444 of the forward bracket 402. Dividers 438, like spacer bar 428, have breakaway portions 448 and 450 to accommodate to the depth of shelf 202. "Shelf-talkers" or flags 452 may optionally be provided to snap on the forward posts 426. The forward post 426 engages in the same manner as the rearward post 426 with the opening 420 of bracket past the notch of extrusion 434.

If desired, a partition (not shown) joining forward and rearward posts 426 may be clamped to the posts or may be molded integral with the posts.

Pusher rail or track 454 illustrated in FIGS. 9, 10 and 11 has a channel 456 which receives the plow 460 of pusher 458 to guide and hold down the pusher. Channel 456 is closed at the forward end 456a. A clip 455 may optionally be provided to engage holes 455a to close the rearward end of channel 456. Forwardly of the plow 460, the end of coil spring 462 emerges from the slot 461 and extends forwardly to be secured about the forward end 456a of the channel 456. In assembling the pusher 458 and spring 462 to the track 454, the plow is inserted in the rearward end of channel 456 before track 454 is placed in the assembly. Spring 462 is then secured about the forward closed end 456a of channel 456.

Referring to FIGS. 10, 11 and 12 the pusher shown in FIG. 9 is more clearly illustrated. Forward wall 459 is bevelled at 459a so that its face presents an angle of about 30° with the horizontal. This small cutaway accommodates sealing edges such as found in tins containing product. This cutaway serves the dual purpose of having the wall 459 bear directly against the side of the tin as well as holding the tin down somewhat to prevent forward tipping. The bottom portion of the pusher has a slot 461 through which the leading end 463 of the spring 462 may extend downwardly and forwardly to be secured at the forward end of track 454.

To place track 454 with its pusher 458 in the display assembly, the tips 464 of side rails 466 are slipped beneath edge 435 of extrusion 434 and then the rearward end 468 of rails 466 are inserted between the guides 444 of the rearward bracket 402. It should be noted that the pusher track 454 has breakaway portions 470 and 472 which can be removed to accommodate to common shelf depths. When a section 470 or 472 is removed, the rearward end of the channel 456 is unchanged from the viewpoint of inserting the plow 460 to place pusher 458 in operative position. Likewise, new ends 468 with holes 455a are formed in the remaining portion of the track. This structure eliminates the need for plugs such as 364 shown in FIG. 8.

Still referring to FIG. 9, the spanner or tie 480 has enlarged ears 482, 486, each having bi-lateral openings 484. The openings 484 of ear 482 may be placed over the reduced upper portions 424 of adjacent front posts 426 to stabilize the structure when a plurality of shelf-display units are placed side-by-side on shelving. The enlarged rearward ears 486 also have openings 484 to receive adjacent rearward posts 426. The spanners or ties 480 have breakaway portions 484 to accommodate to the depth of shelving 202. Ties 480 augment the stability of the second story 490 assisted by the mating dovetails 403, 405.

An adaptor 474 for placement on the pusher when tall packaged goods are used is optionally illustrated in FIG. 9. Adaptor 474 is configured as a letter C which can be placed about the pusher wall 459 to provide a raised height to wall 459. In such a situation, it is frequently necessary for light tall packages such as dry cereals to be retained from falling forward over extrusion 434. In such a configuration, the optional clear stop 476 illustrated in FIG. 9 can be mounted by having its integral pegs 477 inserted into the openings 420. It should be noted that when such tall packages are being used, the "second story" 490 shown at the top of FIG. 9 is not employed and openings 420 are available for pegs 480 since posts 426 are omitted.

Figure 13:
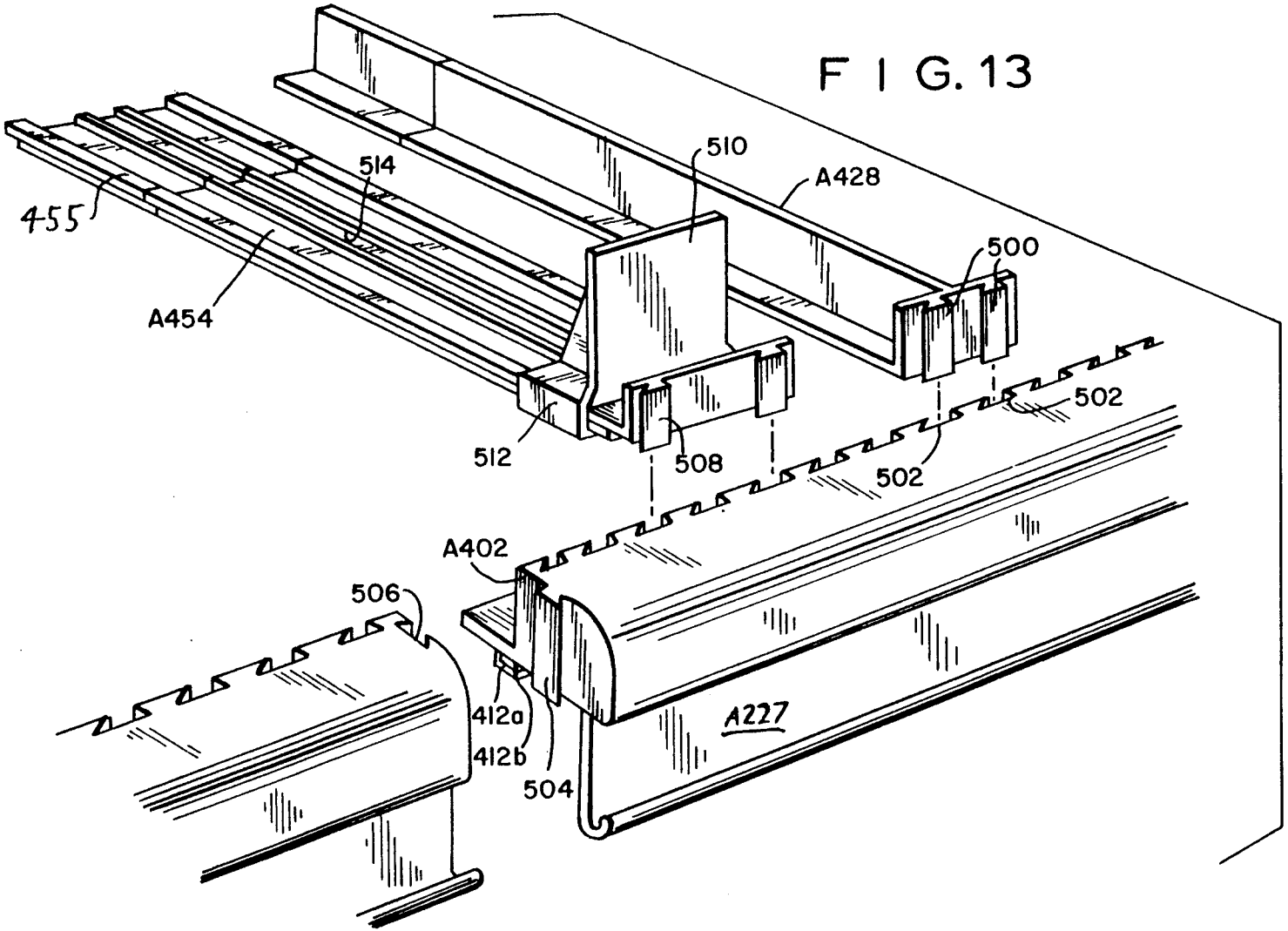
FIG. 13 is a partial exploded view of a another embodiment of the invention showing different interlocking spacer means.

Referring now to FIG. 13, there is shown another embodiment employing dovetail securing means to secure the pusher track, divider and tie bars to the brackets. In this configuration, the divider A428 carries a pair of male dovetails 500 engaging the female dovetails 502 of a bracket A402. Bracket A402 carries an end male dovetail 504 to engage the female dovetail 506 of an adjacent bracket. The pusher rail or track A454 similarly carries a pair of male dovetails 508 to engage female dovetails 502. Price channel A227 may be inserted into bracket A402. The stability provided by the dovetail locking of the divider A438 and track A454 eliminate, in most instances, the need of a rear bracket similar to A402. The guide A454 in FIG. 13 is shown with a pusher 510 employing a wrap-around C-structure 512 to hold it to the guide A454. A coil spring (not shown) providing the biasing force can run in the channel 514 of guide A454. The length of dividers A438 and tracks A454 can be varied by break-off provisions as indicated at A439 and A455, respectively.

It should be obvious to those skilled in the art that any of the pusher tracks and pushers illustrated in the several embodiments may be interchanged among the several embodiments within the spirit of the invention.

We claim:

1. A multi-package shelf display comprising a bottom portion and an upstanding wall, a plurality of positively engaged members on said upstanding wall to arrest movement along said wall, at least one slide instrumentality having at least one means lockingly engaging a selected member of said plurality of members to prevent transverse movement of said instrumentability and pusher means constructed and arranged to move along said slide instrumentality in one direction and adapted to push a column of packages along said slide instrumentality in said one direction.

2. The display set forth in claim 1 further characterized by a plurality of said slide instrumentalities selectively positioned at spaced intervals along said wall by selectively engaging other of said plurality of members to selectively position said slide instrumentalities along the length of said upstanding wall.

3. The display set forth in claims 1 or 2 further characterized in that a slide instrumentality includes an elongated member positioned normal to said wall, said pusher means include a pusher mounted for movement along said elongated member and a device in contact with said pusher and said slide instrumentality and constructed and arranged to move said pusher in one direction along said elongated member.

4. A display as set forth in claim 1 further characterized by at least one partition positively engaging a second selected member to maintain said partition parallel said slide instrumentality to guide packages in said column pushed by said pusher means.

5. A display as set forth in claim 1 further characterized by a second upstanding wall spaced from said first named wall, partitions extending between said walls, the ends of one of said partitions being selectively supported along said second wall and a selected member of said plurality of members to form a channel, and said slide instrumentality is selectively positioned in said channel between adjacent partitions, the width of said channel being selectively variable by moving the ends of at least one of said partitions to and from the adjacent partition.

6. A display as set forth in claim 4 further characterized by a plurality of partitions forming a plurality of channels and a plurality of slide instrumentalities in said plurality of channels selectively retained by said members and said wall to selectively secure said instrumentalities in said channels.

7. The display set forth in claim 1 further characterized in that said slide instrumentality includes at least one pair of rails, means supporting said rails on said slide instrumentality in spaced parallel relationship, the ends of said rails adapted to engage selected ones of said plurality of members, and said rails comprise means for supporting a package moved by said pusher means.

8. The display set forth in claim 7 further characterized by biasing means to urge said pusher in one direction along said instrumentalities.

9. The display set forth in claim 2 further characterized in that said slide instrumentality comprises:

a spacer plate;

rails mounted on said spacer plate;

said rails having a portion engageable with said plurality of members;

said spacer plate having a slot running parallel said rails for a substantial distance;

parallel tracks between said rails mounted on said spacer plate;

a pusher mounted to slide on said tracks;

a plow on said pusher engaged in said slot to hold said pusher down upon said tracks; and a coiled spring secured between said pusher and said spacer plate and constructed and arranged to move said pusher along said spacer plate and said slot to move packages on said rails to said upstanding wall.

10. The display set forth in claim 4 further characterized in that said slide instrumentality includes:

a spacer plate parallel said partition;

tracks mounted on said spacer plate;

instrumentalities to engage other of said plurality of members to position said spacer plate along said partition;

a slot formed in said spacer plate running parallel thereto;

said pusher means mounted to slide on said tracks;

said pusher means down upon said track; and biasing means constructed and arranged to move said pusher in one direction along said tracks.

11. A multi-package adjustable display-dispenser comprising a tray having a bottom portion and upstanding front and rear walls, the upstanding front and rear walls having a plurality of positive engageable devices therealong, a pair of movable partitions supported by lockingly engaging selected devices of said plurality of devices on each of said oppositely facing walls to define a channel of pre-determined width, and pusher means constructed and arranged to move along said channel from said rear wall to said front wall, whereby packages placed between said partitions may be moved by said pusher means and the width of said channel and said packages selectively varied.

12. A multi-product adjustable display-dispenser comprising a bracket, first devices on said bracket, a partition, second devices on an end of said partition to matingly engage said first devices on said bracket to define a channel, a member with a pusher slidably mounted for movement therealong, said member having third devices to matingly engage other of said first devices on said bracket to position said member in said channel, said member has transverse linear weakened portions at spaced intervals at the end of said member distant from said third devices provided for breakingly removing fixed portions of said member to shorten its linear dimensions whereby it may be accommodated to a selected shelf depth.

13. A multi-package shelf display comprising an upstanding front wall having a base supporting said wall, said base forming a rearwardly extending ledge, an upstanding rear wall having a base forming a forwardly extending ledge, means to secure said forward and rearward base portions to a supporting shelf, said front wall and said rear wall each having a plurality of members therealong, at least one slide member having a member lockingly engageable with selected ones of said plurality of members at said front and rear walls, one end portion of said slide member having spaced means to selectively breakaway at least one terminal portion thereof, pusher means constructed and arranged to move along said slide member forwardly toward said front wall when said slide member is lockingly engaged thereto for pushing a column of packages forwardly upon removal of a forwardmost package, whereby said front and rear walls may be secured to a shelf and said slide member by breakaway may be adapted to engage said front and rear walls in accordance with the depth dimension of said shelf.

14. A device as claimed in claim 13 and further characterized by partitions lockingly engageable with selected members of said plurality of members to provide channels wherein said slide member may be positioned.

15. A device substantially as set forth in claim 14, further characterized in that at least two of said partitions are of substantial height to exceed the height of the packages placed upon said slide member, a second set of front walls and rear walls, cooperating means on said partitions and said second set of front walls and rear walls to support said walls on said partitions in vertical spaced relationship to said first set of walls.

16. A device substantially as set forth in claim 13 and further characterized by a price channel and means to secure said price channel at the front of said front wall.

17. A device as set forth in claim 14 and further characterized by a flag secureable to a forward edge of said partitions.

18. A device substantially as set forth in claim 13 and further characterized in that said slide member has a central longitudinal slot, transverse linear weakened portions at spaced intervals at one end of said slide member to provide for breakingly removing fixed portions of said slide member to shorten its linear dimension whereby it can be adjustably accommodated to the dimensions of a selected shelf to which said front walls and said rear walls are secured.

19. A device as set forth in claim 18 and further characterized in that said slide member has a pusher mounted thereon, said pusher having a foot engaging in and guided by said slot, resilient means connected to said slide and said pusher to move said pusher in one direction along said slide.

20. For a multi-package shelf display, a slide member, said slide member having spaced means for selectively severing at least one end portion to vary the length thereof, means to secure said slide member to a shelf, pusher means constructed and arranged to move along said slide member, means biasing said pusher means toward the front edge of said shelf.

21. The device set forth in claim 20 and further characterized by parallel rails on said slide member to support articles for sliding movement therealong, a track on said slide member to engage and guide said pusher means therealong and said biasing means comprises a coiled spring housed in one of said pusher, said slide member and the forward edge of said shelf and having its free end secured to another of said pusher, said slide member and the forward edge of said shelf.

22. A plurality of devices as set forth in claim 20 characterized in that said slide members may be selectively positioned on said shelf at selected spaced positions.

23. The device set forth in claim 22 and further characterized by a plurality of walls parallel said slide members and selectively spaced therebetween to define guide channels for articles moved by said pusher means on said slide members.

24. The device of claim 20 wherein said spaced means are at the rearward end of said slide member.

25. The device of claim 20 wherein said spaced means are at the forward end of said slide member.

26. The device of claim 24 wherein said slide member has an enlarged opening between said spaced means, and said pusher means has a plow insertable into said enlarged opening.

27. The device of claim 20 wherein said slide member has an enlarged opening between said spaced means, and said pusher means has a plow insertable into said enlarged opening.

28. A multi-product adjustable display-dispenser comprising a pair of spaced parallel brackets, a plurality of lockingly engageable devices on at least one of said brackets on an aspect of said bracket facing toward the other of said brackets, means to secure said brackets to a horizontal surface, partitions extending between said brackets to define channels of predetermined width, said partitions being supported in said predetermined position by lockingly engaging said devices on at least one of said brackets, a member with a pusher slidably mounted for movement therealong, said member being securable between said brackets and between a pair of said partitions, said devices supporting said member.

29. A device substantially set forth in claim 28 and further characterized in that said member and said partitions have breakaway portions whereby said partitions and said member may be of a length selected to correspond to a selected distance between said brackets.

30. A multi-product adjustable display-dispenser comprising a bracket, first devices on said bracket, a partition, second devices on an end of said partition to lockingly engage said first devices on said bracket to define a channel, a member with a pusher slidably mounted for movement therealong, said member having third devices to lockingly engage other of said first devices on said bracket to position said member in said channel whereby said member with said pusher may support and move product along said channel.

31. A multi-product adjustable display-dispenser comprising a bracket, first devices on said bracket, a partition, second devices on an end of said partition to matingly engage said first devices on said bracket to define a channel, a member with a pusher slidably mounted for movement therealong, said member having third devices to matingly engage other of said first devices on said bracket to position said member in said channel and said member and said partition have breakaway portions whereby said partition and said member may be selectively shortened to a preselected length and said member with said pusher may support and move product along said channel.

32. A device substantially as set forth in claim 31 and further characterized by a member secured at the forward end of said partition to form a stop in said channel to arrest product moved therealong.

33. A device substantially as set forth in claim 31 and further characterized by an optically selected member having instrumentalities to matingly engage said first devices on said bracket to form a stop in said channel, said stop being formed of material optically selectable from a class comprising opaque, translucent or transparent material.

34. A multi-product adjustable display-dispenser comprising a bracket, first devices on said bracket, a partition, second devices on an end of said partition to matingly engage said first devices on said bracket to define a channel, a member with a pusher slidably mounted for movement therealong, said member having third devices to matingly engage other of said first devices on said bracket to position said member in said channel and a first stop positioned in a lower portion of said channel and having instrumentalities to engage said first devices and a second stop positioned higher in said channel and having instrumentalities to engage said partition.

35. The display dispenser set forth in claim 31 and further characterized by a C-shaped price channel securable to said bracket.

36. The display dispenser set forth in claim 35 and further characterized by a shelf-talker having instrumentalities to engage said C-shaped price channel.

* * * * *

UNITED STATES PATENT AND TRADEMARK OFFICE

CERTIFICATE OF CORRECTION

PATENT NO. : 5,190,186

DATED : March 2, 1993

INVENTOR(S) : GERALD YABLANS et al

It is certified that error appears in the above–identified patent and that said Letters Patent is hereby corrected as shown below:

Column 9, line 63 before "said" (first occurrence) insert -- a plow on said pusher means engaged in said slot to hold--.

Column 10, line 1 "positive" should be -- positively--.

Signed and Sealed this

Twenty-second Day of March, 1994

Bruce Lehman

*Attest:*

BRUCE LEHMAN

*Attesting Officer*

*Commissioner of Patents and Trademarks*